United States Patent [19]

Marvin

[11] Patent Number: 4,793,647

[45] Date of Patent: Dec. 27, 1988

[54] CUP CADDY

[76] Inventor: Claire C. Marvin, 104 N. Greenwood, Park Ridge, Ill. 60068

[21] Appl. No.: 115,523

[22] Filed: Nov. 2, 1987

[51] Int. Cl.[4] ..... B65D 71/00

[52] U.S. Cl. ..... 294/87.2; 206/150; 206/162; 206/199; 206/427; 294/159

[58] Field of Search ..... 294/31.2, 87.1, 87.2–87.28, 294/137, 146, 148, 149, 159, 165; 206/139, 145, 150, 151, 158, 162, 163, 199, 427, 428, 431; 215/100 A; 220/94 R, 94 B; 229/1.5 H

[56] References Cited

U.S. PATENT DOCUMENTS

| | | | |
|---|---|---|---|
| 1,151,163 | 8/1915 | Cederholm | 294/87.24 |
| 1,427,440 | 8/1922 | Brown . | |
| 2,194,898 | 3/1940 | Hanford . | |
| 2,533,997 | 12/1950 | Cochrane . | |
| 2,553,764 | 5/1951 | Hawkins . | |
| 2,654,628 | 10/1953 | Klante . | |
| 2,809,861 | 10/1957 | Socke . | |
| 2,856,069 | 10/1958 | Felber . | |
| 2,994,426 | 8/1961 | Biesecker et al. | 294/87.2 X |
| 2,998,174 | 8/1961 | Weder et al. . | |
| 3,094,259 | 6/1963 | Diehl | 294/159 |
| 3,137,423 | 6/1964 | Tupper . | |
| 3,186,544 | 6/1965 | Curry et al. . | |
| 3,192,682 | 7/1965 | Bernat, Jr. . | |
| 3,232,422 | 2/1966 | Whyte . | |
| 3,258,288 | 6/1966 | Courter . | |
| 3,262,727 | 7/1966 | Blackaby . | |
| 3,268,070 | 8/1966 | Cunningham . | |
| 3,269,530 | 8/1966 | Wanderer . | |
| 3,307,321 | 3/1967 | Beart . | |
| 3,311,252 | 3/1967 | Swartwood et al. . | |
| 3,325,004 | 6/1967 | Wanderer . | |
| 3,339,814 | 9/1967 | Carbine . | |
| 3,341,242 | 9/1967 | Carson . | |
| 3,341,245 | 9/1967 | Wolford . | |
| 3,344,950 | 10/1967 | Erickson . | |
| 3,369,696 | 2/1968 | Erickson . | |
| 3,385,626 | 5/1968 | Wozniak . | |
| 3,421,790 | 1/1969 | Carson | 294/159 X |
| 3,462,009 | 8/1969 | Moore . | |
| 3,594,891 | 7/1971 | Cunningham et al. . | |
| 3,608,949 | 9/1971 | Owen . | |
| 3,612,595 | 10/1971 | Updegraff et al. . | |
| 3,653,610 | 4/1972 | Owen . | |
| 3,682,352 | 8/1972 | Doucette . | |
| 3,688,899 | 9/1972 | Walter . | |
| 3,688,935 | 9/1972 | Owen, et al. . | |
| 3,717,277 | 2/1973 | Stengle, Jr. . | |
| 3,727,754 | 4/1973 | Cunningham . | |
| 3,784,003 | 1/1974 | Bolton . | |
| 3,785,484 | 1/1974 | Cunningham . | |
| 3,830,361 | 8/1974 | Klygis . | |
| 3,831,741 | 8/1974 | Poupitch . | |
| 3,860,112 | 1/1975 | Klygis . | |
| 3,891,084 | 6/1975 | Elizondo-Garcia | 294/159 X |
| 3,900,103 | 8/1975 | Day . | |
| 3,930,578 | 1/1976 | Stein . | |

(List continued on next page.)

FOREIGN PATENT DOCUMENTS

| | | |
|---|---|---|
| 454236 | 1/1949 | Canada . |
| 753970 | 3/1967 | Canada . |
| 966091 | 4/1975 | Canada . |
| 0142360 | 5/1985 | European Pat. Off. . |
| 2322478 | 11/1974 | Fed. Rep. of Germany . |
| 2409098 | 2/1975 | Fed. Rep. of Germany . |
| 827710 | 5/1938 | France . |
| 1059515 | 3/1954 | France . |

(List continued on next page.)

OTHER PUBLICATIONS

Modern Packaging Magazine, vol. 37, no. 4, pp. 105, Dec. 1963

*Primary Examiner*—Johnny D. Cherry

[57] ABSTRACT

A cup carrier is provided having a plurality of circular cup engaging portions each supported by a support web at generally opposite sides of the cup engaging portions. The support webs each extend to a bail portion having a handle by which the cup carrier is carried. Certain ones of the support webs are formed by doubled back portions, and an elongating element is provided in a center support web so that each drink cup is supported independently and in a level condition.

18 Claims, 2 Drawing Sheets

U.S. PATENT DOCUMENTS

| | | | |
|---|---|---|---|
| 4,045,070 | 8/1977 | Geisinger . | |
| 4,093,295 | 6/1978 | Erickson | 294/87.2 |
| 4,103,811 | 8/1978 | Owen . | |
| 4,109,787 | 8/1978 | Klygis et al. . | |
| 4,155,502 | 5/1979 | Forte . | |
| 4,196,807 | 4/1980 | Brom | 294/87.2 X |
| 4,269,308 | 5/1981 | Platt . | |
| 4,269,314 | 5/1981 | Barrash . | |
| 4,357,042 | 11/1982 | Gall . | |
| 4,385,690 | 5/1983 | Olsen . | |
| 4,385,691 | 5/1983 | Klygis . | |
| 4,390,095 | 6/1983 | Cunningham . | |
| 4,396,128 | 8/1983 | Larson et al. . | |
| 4,412,624 | 11/1983 | Tanaka . | |
| 4,513,860 | 4/1985 | Rhoads . | |
| 4,520,924 | 6/1985 | Edwards et al. . | |
| 4,523,676 | 6/1985 | Barrash . | |
| 4,545,480 | 10/1985 | Klygis . | |
| 4,546,876 | 10/1985 | Rhoads . | |
| 4,548,317 | 10/1985 | Weaver . | |
| 4,550,824 | 11/1985 | Rhoads . | |
| 4,557,375 | 12/1985 | Weaver et al. . | |
| 4,582,215 | 4/1986 | Barrash . | |
| 4,623,185 | 11/1986 | Thomas . | |

FOREIGN PATENT DOCUMENTS

| | | |
|---|---|---|
| 1349429 | 12/1963 | France . |
| 642333 | 10/1962 | Italy . |
| 84143 | 10/1952 | Norway . |
| 316048 | 10/1956 | Switzerland . |
| 5760 | 1/1985 | Switzerland . |
| 911277 | 11/1962 | United Kingdom . |
| 1415781 | 11/1975 | United Kingdom . |

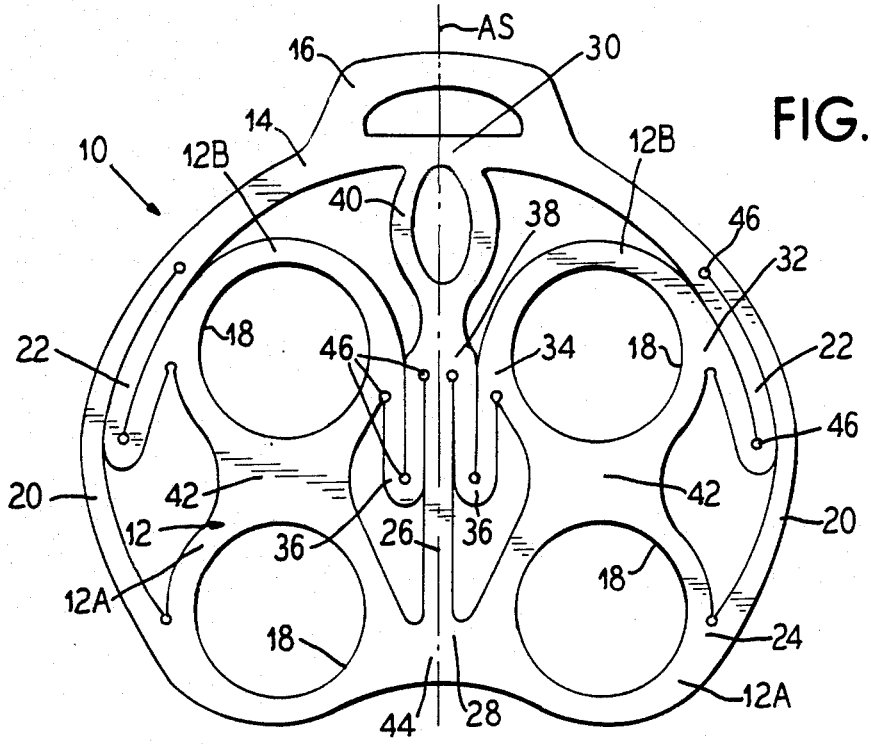
FIG. 1
FIG. 3
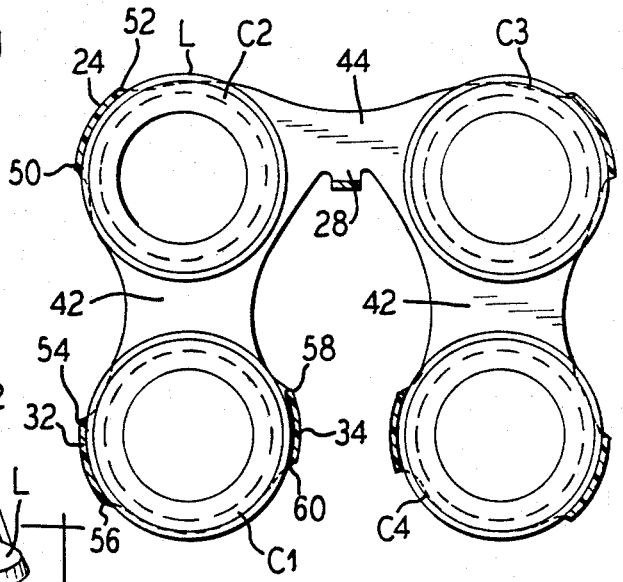
FIG. 2
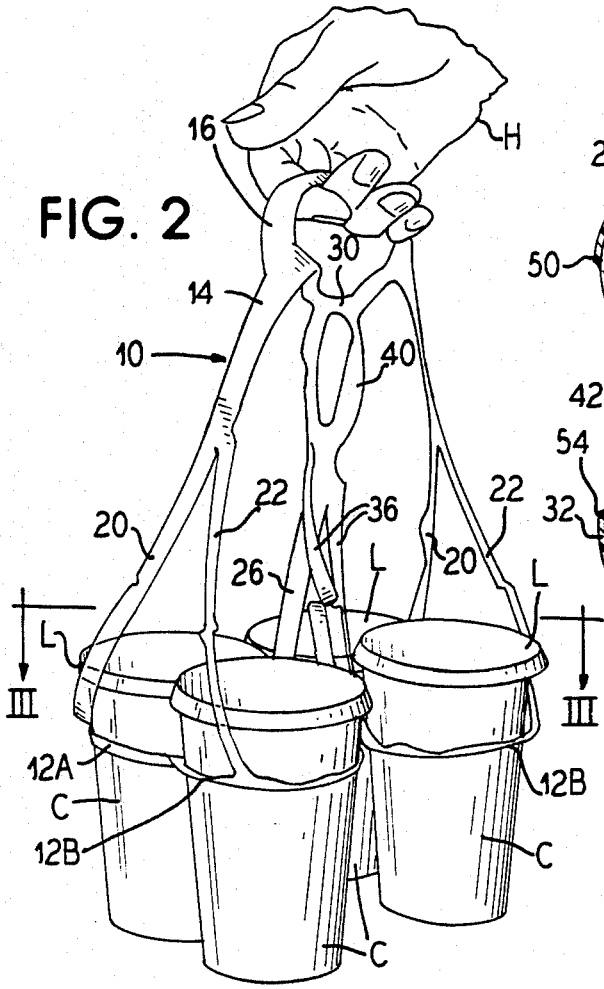

CUP CADDY

BACKGROUND OF THE INVENTION

1. Field of the Invention

The present invention relates generally to a carrier or tote formed from a single sheet of material for carrying up to a predetermined number of drink cups.

2. Description of the Related Art

Food service facilities generally provide cups of paper, plastic or cardboard for carryout drink service. When more than one drink is purchased by a customer, the difficulty of carrying several drink cups from the food service facility becomes apparent. Customers often attempt to balance or hold the drink cups individually, frequently resulting in spills. On occasion, the drink cups are placed into a paper bag for carryout. However, paper bags lack stability to maintain the drink cups upright and spills occur within the paper bag, the paper weakens and the drink cups fall through the bottom of the paper bag.

Frequently, multiple drink orders are provided with a cardboard tray for holding the drink cups. The drink cups rest on a bottom floor of the tray, and the sides of the cups near the bottom are engaged by a second portion of the tray. Such trays are generally insufficiently strong to adequately support drink cups full of liquids. Also, by engaging the drink cups at points near the bottom of the cup, instability during carrying results, often leading to tipping of the cups and spilling of the contents thereof.

SUMMARY OF THE INVENTION

The present invention provides a caddy or carrier for drink cups of different sizes which reduces the chance of spilling the contents of the drink cups. The present invention also provides a carrier for up to a predetermined number of drink cups which is stable for carrying any number of drink cups up to the predetermined number. The present drink cup caddy also supports a plurality of drink cups in a level condition.

These and other advantages of the invention are achieved in a cup carrier formed from a single sheet of material and including a plurality of cup engaging portions, each for encircling a cup in an engaging relationship. The cup engaging portions can each hold cups of different sizes. Support webs extend from generally opposite sides of the cup engaging portions for independently supporting each of the cup engaging portions in a level position. Although the support webs may be on diametrically opposed sides of the cup engaging portions, this is not always required so long as the cups are supported in a substantially level position. A bail is included spanning the predetermined number of cup engaging portions and affixed either directly or indirectly to each of the support webs. A handle may be provided generally at the center of the bail for holding and suspending the cup carrier of the present invention.

Thus, there is provided a cup carrier or caddy for drink cups and the like which can carry one, two, three, or more drink cups, each in a level position. The bail provides a convenient grip by which the caddy is suspended and carried so that drink cups can be carried from a food service area such as for carry out service.

The cup carrier of the present invention provides sufficient stability to prevent spilling of the liquid in the drink cups and to avoid the tendency of the drink cups to tip. The present cup carrier is strong, light, and easy to manufacture from a single sheet of material, such as of plastic.

BRIEF DESCRIPTION OF THE DRAWINGS

FIG. 1 is a plan view of a cup caddy according to the principles of the present invention;

FIG. 2 is a perspective view of the cup caddy of FIG. 1 shown holding four drink cups;

FIG. 3 is a cross section along line III—III of FIG. 2 showing the suspended relationship of the four cups in the present cup caddy;

DESCRIPTION OF THE PREFERRED EMBODIMENTS

Figure 4:
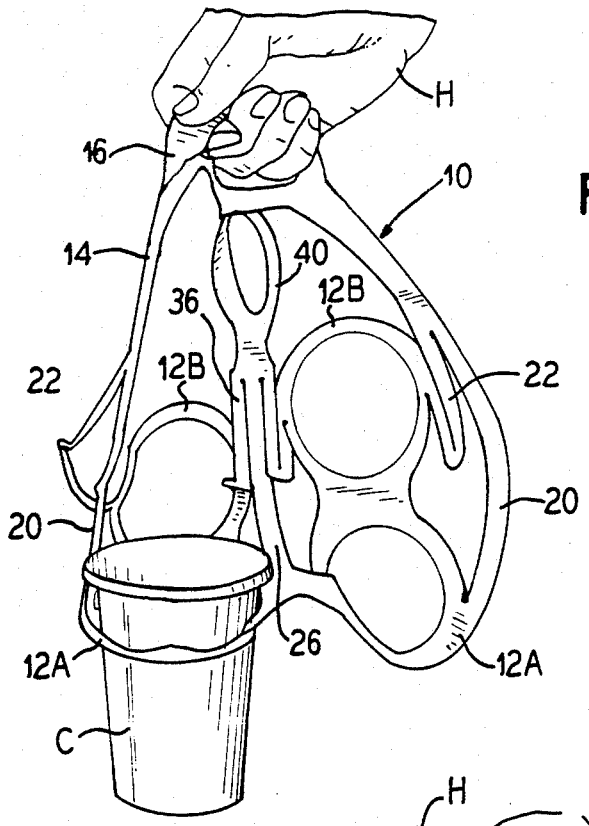
FIG. 4 is a perspective view of the cup carrier of the invention shown holding a single drink cup.

With reference to the drawings, and with reference first to FIG. 1, a cup caddy or carrier 10 of a preferred embodiment includes four cup engaging portions 12A and 12B and a bail 14 with a handle 16. Each of the cup engaging portions includes a circular opening 18 into which a drink cup or the like is received. Since drink cups generally have an increasing diameter in the direction toward the top of the cup, the circular openings 18 will engage the sides of a drink cup and prevent the cup from falling therethrough. Although it is envisioned that the diameter of the circular openings 18 may be of various sizes to accommodate any size drink cup, it is recognized that most drink cups of different sizes have a common diameter at some location along the length of the cup sides. Thus, it is possible to engage different sizes of drink cups in an opening of a predetermined diameter. For instance, small, medium and large drink cups may be held securely in a cup engaging portion 12A or 12B having a circular opening 18 with a diameter of approximately 3 ¼ inches, although other sizes are, of course, contemplated. The size of the opening 18 depends on the size of the cups to be held therein.

The cup carrier 10 is symmetrical about an axis of symmetry AS so that the right hand side of the cup carrier is substantially identical to the left hand side of the carrier. On the right hand side, the bail 14 is connected to a first cup engaging portion 12A by a direct support web 20, while a second cup engaging portion 12B on the right side is connected to the bail 14 by a doubled-back support web 22. The doubled-back support web 22 straightens into a single elongated length of support web substantially identical in length to the support web 20 when drink cups are suspended from the bail 14 in the cup engaging portions 12A and 12B.

The web 20 supports the cup engaging portion 12A generally from a region 24. On an opposite side of the cup engaging portion 12A from the support region 24 is a center support web 26. The center support web 26 extends from a region 28 generally diametrically opposed to the region 24 across the cup engaging portion 12A. The weight of a cup in the cup engaging portion 12A is, thus, supported from the regions 24 and 28 on opposite sides of the cup. An opposite end of the center support web 26 is connected at a center 30 of the bail 14.

The cup engaging portion 12B is supported from the outside doubled-back support web 22 at a region 32. Across the cup engaging portion 12B from the region 32 is a region 34 to which is connected a center doubled-back support web 36. The center doubled-back support web 36 is connected to the center support web 26 at a region 38. Like the outside doubled-back support web 22 and the web 20, the center doubled-back support web 36, when straightened is substantially equal in length to the portion of the center support web 26 extending from the region 28 to the region 38. In other words, the doubled-back support webs 22 and 36 are shaped to support the cup engaging portion 12B at substantially the same level as the cup engaging portion 12A.

In the center support web 26 between the region 38 and the connection 30 at the center of the bail 14 is provided length expansion element 40. The length expansion element 40 is shown as an oval loop which narrows as weight is put on the center support web 26 and/or the doubled-back support web 36. This narrowing provides an increase in the length of the center support web 26 relative to the sides of the bail 14. The increase in the length provided by the expansion element or loop 40 is sufficient to enable drink cups contained in the cup engaging portions 12 to be supported in a level condition. Although an oval loop is shown as the length expansion element 40, tho element 40 may also be circular or of a diamond shape to provide additional lengthening. Any other lengthening means, such as crimping, may also be provided. The amount of lengthening required of the length expansion element 40 depends upon the flexibility and elasticity of the material from which the caddy 10 is formed.

In the illustrated embodiment, the handle 16 is connected to the bail 14 to provide a gripping location by which the cup carrier or caddy 10 can be carried. Optionally, the handle 16 can be left off and the cup carrier carried by grasping the bail 14, such a at the center portion 30. The shape and size of tho handle 16 determines an additional lengthening which may be available for the center web 26.

Between the cup engaging portion 12A and the cup engaging portion 12B is provided a connecting web 42. The connecting web 42 maintains spacing between the cup engaging portions 12A and 12B. A connecting link 44 is provided between the symmetric halves of the cup carrier 10 extending between the two cup engaging portions 12A. The link 44 also maintains spacing between adjacent cup engaging portions. Although some support is provided by the connecting web 42 and the link 44, they principly provide only lateral stability. The illustrated embodiment has solid webs 42 and links 44. Openings may also be cut in these elements.

Advertising or other illustrations and/or text may be provided on the handle 16, the bail 14 and/or the webs. If printed simultaneously with the cutting operation, alignment of the advertising, etc. is guaranteed. The material from which the device is made can be of various colors, and may even have certain elements, such as the handle, cut in a distinctive shape representative of the advertised entity.

The embodiment of FIG. 1 is formed by cutting of a single sheet of plastic, plasticized paper, or like material. In an exemplary embodiment, the sheet is of plastic having a thickness of 8 mils. During cutting of the sheet material, small circular punches 46 are provided at each of the sharply cut corners to prevent tearing of the sheet material during use of the present device by providing a stress relief area.

In FIG. 2, the cup carrier 10 of FIG. 1 is shown supporting four drink cups C, each having a snap-on lid L. Each of the cups C is in one of the circular openings 18 in one of the cup engaging portions 12A and 12B. The support webs 20, 22, 26 and 36 extend upwardly and connect to the bail 14, the center support webs 26 and 36 are connected to the bail 14 through the length expansion loop 40. Once the cups C are in place, the bail 14 is swung upward and supported at the handle 16, such as by a hand H. As can be seen, the doubled-back outer support webs 22 and the doubled-back center support webs 36 straighten out to support the two cup engaging portions 12B. During suspension of the cup carrier 10 by the bail 14, the length expansion element 40 lengthens so that the center support webs 26 and 36 support the cups C in a level position. When a handle 16 is provided, the center portion 30 of the bail 14 may sag down, as illustrated, so that the elongation of the element 40 need not be as pronounced as when no handle or when a stiffer handle 16 is provided.

Referring now to FIG. 3, the support regions on generally opposite sides of the cups C can be seen. Each cup C is supported individually and independently of the other cups C. For example, a cup C1 is supported primarily by the regions 32 and 34 at opposite sides thereof which connect to the support webs 22 and 36, respectively. The cup C2 is supported by the regions 24 and 28 which are connected to the support webs 20 and 26, respectively. Similarly, the cups C3 and C4 are supported generally at opposing sides thereof by similar regions and support webs on the symmetrical other side of the cup carrier 10. When in use to carry four cups, the device defines a U-shaped planar support from which the support webs extend.

The weight distribution across the regions 24, for example, vary. In particular, more of the weight of the cup C2 is supported at a side 50 of the region 24 than at a side 52. Of the region 32, a side 54 supports a greater portion of the cup C1 weight than a side 56. A side 58 of the region 34 sustains a greater weight of the cup than a side 60. Thus, more weight is supported adjacent the stress relief openings 46 of each support web.

Since each of the cup engaging portions 12 is supported independently by support webs connected to the bail 14, each cup engaging portion 12 can hold an individual drink cup. For example, as can be seen in FIG. 4 a single drink cup C is supported in the cup engaging portion 12A by the support webs 20 and 26. The support web 20 connects directly to the bail 14, which in turn is connected to the handle 16 gripped in the hand H, while the center support web 26 is connected to the bail 14 through the loop 40. Since the support web 20 and 26 are affixed generally at opposite sides of the cup engaging portion 12A, the cup is supported independently in a generally level condition irrespective of whether other cups are provided in the other cup engaging portions.

Figure 5:
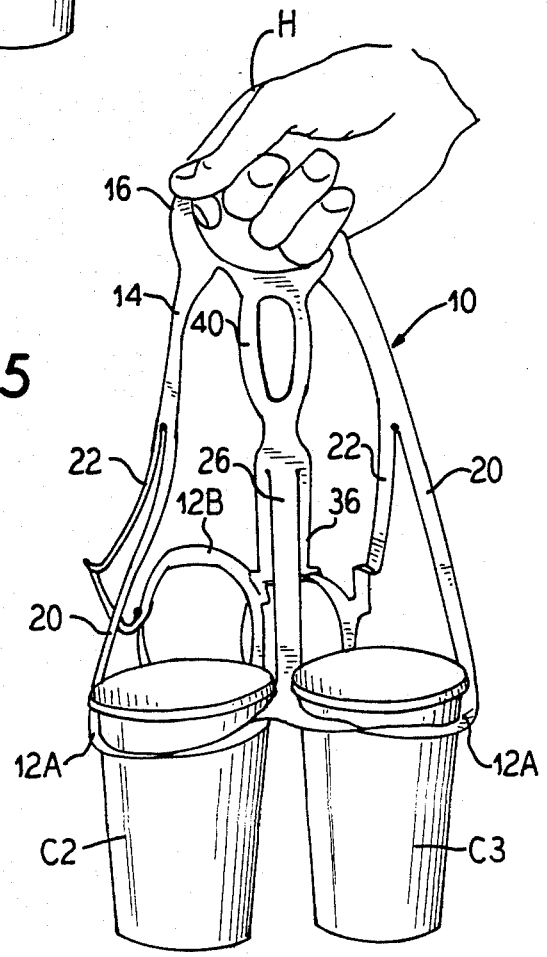
FIG. 5 is a perspective view of the present cup carrier shown holding two drink cups.

In FIG. 5, two cups C2 and C3 are supported in the cup carrier or caddy 10 of the invention. As illustrated, the cups C2 and C3 are each in one of the cup engaging portions 12A and are supported at mutually opposed sides by the support webs 20 extending to the bail 14. Between the cups C2 and C3, the link web 44 is connected to the center support web 26 to maintain the cups C2 and C3 in a level condition. Although both cups C2 and C3 are contained in the cup engaging portions 12A, it is also possible that both of the cups could be supported in the cup engaging portions 12B or that one cup could be in the cup engaging portion 12A and the other in cup engaging portion 12B, either on the same side of the symmetrical cup carrier 10 or on opposite sides thereof.

By supporting the cups independently, the cups can be of mutually different sizes, and the resulting different weights of the cups will not cause tipping of the cups. Each of the cups is removable while holding the handle 16 and the remaining cups will not be placed off-balance.

Thus, the present invention provides a versatile yet simple apparatus for carrying one, two, three, or four drink cups filled with liquid, while maintaining the drink cups in a level condition and preventing spilling of the liquid therefrom. The present device is inexpensive and simple to manufacture yet reliable in operation. The apparatus finds use at sporting events, fast food restaurants, carry-out food services and other occasions when several drink containers are to be carried.

During tests of the present apparatus, it has been determined that not only are each of the cups suspended in the present device in a level condition, but each is so maintained irrespective of the number of other cups in the cup carrier. The cups are engaged sufficiently tightly in the cup carrier that the entire apparatus can be swung about without risk of disengaging the cups and with little chance of spilling the liquid contained in the drink cups. The 8 mil plastic sheeting of which the preferred embodiment is formed is sufficiently strong to carry four large drinks without significant stretching. Thus, the present invention provides an ideal cup carrier for carry-out food service facilities which enables a customer of the food service facility to carry up to four drink cups in a single hand without accidental spilling.

It is of course possible to apply the principles of the invention to make a cup carrier of a different capacity than that of the preferred embodiment. For example, by severing the present cup carrier generally along the axis of symmetry, it may be possible to provide a two cup carrier using the same principles. It is also possible to apply the principles established herein to a three cup carrier, a five or six cup carrier or to an even greater capacity cup caddy.

Although other modifications and changes may be suggested by those skilled in the art, it is the intention of the inventor to embody within the patent warranted hereon all changes and modifications as reasonably and properly come within the scope of his contribution to the art.

I claim:

1. A cup carrier for carrying up to a predetermined number of cups, comprising:

a predetermined number of flexible cup engaging portions each for completely encircling a cup in an engaging relationship;

each of said engaging portions having a pair of flexible support webs extending generally from opposite sides of said cup engaging portions for supporting each of said cup engaging portions substantially independently of others of said cup engaging portions; and a flexible bail connected to each of said support webs and spanning said predetermined number of cup engaging portions, said cup engaging portions and said bail and said support webs being sufficiently flexible to support each of said cup engaging portions in a substantially level condition when suspended from said flexible bail regardless of the presence of cups in others of said cup engaging portions, ones of said cup engaging portions which are free of a cup being capable of movement out of a plane defined by ones of said cup engaging portions in a engaging relationship with a cup.

2. A cup carrier as claimed in claim 1, wherein said predetermined number of cup engaging portions is four.

3. A cup carrier as claimed in claim 1, wherein said cup carrier is formed from a flat sheet of flexible material.

4. A cup carrier as claimed in claim 1, further comprising:

a center support web connecting a center portion of said bail to between adjacent ones of said cup engaging portions.

5. A cup carrier as claimed in claim 1, further comprising:

a handle portion on said bail.

6. A cup carrier for carrying up to a predetermined number of cups, comprising:

a predetermined number of cup engaging portions each for encircling a cup in an engaging relationship;

each of said engaging portions having a pair of support webs extending generally from opposite sides of said cup engaging portions for substantially independently supporting each of said cup engaging portions;

a bail connected to each of said support web and spanning said predetermined number of cup engaging portions; and a center support web connecting a center portion of said bail to between adjacent ones of said cup engaging portions, said center support web including strap portions doubled back on themselves to extend into an elongated strap when one or more cups are suspended in said cup carrier.

7. A cup carrier for carrying up to a predetermined number of cups, comprising:

a predetermined number of cup engaging portions each for encircling a cup in an engaging relationship;

each of said engaging portions having a pair of support webs extending generally from opposite sides of said cup engaging portions for substantially independently supporting each of said cup engaging portions;

a bail connected to each of said support webs and spanning said predetermined number of cup engaging portions;

a center support web connecting a center portion of said bail to between adjacent ones of said cup engaging portions; and means for lengthening said center support web relative to said bail to enable the cups to be supported substantially level in said cup engaging portions when said cup carrier is suspended by said ball.

8. A cup carrier for carrying up to a predetermined number of cups, comprising:

a predetermined number of cup engaging portions each for completely encircling a cup in an engaging relationship;

each of said engaging portions having a pair of flexible support webs extending generally from opposite sides of said cup engaging portions for substantially independently supporting each of said cup engaging portions;

a flexible bail connected to each of said support webs and spanning said predetermined number of cup engaging portions, each of said cup engaging portions being supported in a substantially level condition when suspended from said flexible bail; and ones of said support webs being affixed to said bail and each of said ones including doubled back portions to extend into an elongated support web when the cups ar suspended in said cup carrier.

9. A cup caddy for carrying up to four drink cups, comprising:

four cup engaging portions each having a substantially circular opening for receiving drink cups;

a bail spanning said cup engaging portions;

connecting webs linking said four cup engaging portions to define a planar U-shaped member having two arms and a base;

a center support web connected to said base of said U-shaped member and extending to generally a center of said bail;

first and second outside support webs connected to one of said cup engaging portions at respective opposite sides of said base of said U-shaped member, opposite ends of said first and second outside support webs being connected to respective opposite ends of said bail;

first and second outside doubled-back support webs connected to other ones of said cup engaging portions at respective opposite outside sides of said arms of said planar U-shaped member, said first and second outside doubled-back support webs connected to respective opposite ends of said bail;

first and second center doubled-back support webs connected to said other ones of said cup engaging portions at respective inside sides of said arms of said U-shaped member, said first and second center doubled-back support webs connected to said center support web, so that up to four drink cups can be carried in said caddy suspended from said bail.

10. A cup caddy as claimed in claim 9, further comprising:

a handle connected across a center of said bail for holding said cup caddy.

11. A cup caddy as claimed in claim 9, wherein said cup caddy is cut from a sheet of plastic.

12. A cup caddy as claimed in claim 9, further comprising:

a length expansion element in said center support web.

13. A cup caddy as claimed in claim 12, wherein said length expansion element is in said center support web between said center doubled-back support webs and said bail.

14. A cup caddy as claimed in claim 12, wherein said length expansion element is formed by a loop in said center support web.

15. A cup carrier, comprising:

means for engaging a predetermined number of cups;

means for suspending said cup engaging means;

a center support web connected between ones of said cup engaging means and extending from said cup engaging means to approximately a center of said suspending means; and means for lengthening said center support web to support said cups in a substantially level condition when suspended by said suspending means.

16. A cup carrier for carrying up to a predetermined number of cups, comprising:

a predetermined number of cup engaging portions encircling up to a predetermined number of said cups;

means connected said cup engaging portions to form a base;

a handle for suspended carrying of said up to a predetermined number of cups in said cup carrier; and flexible means for individually supporting said cup engaging portions in suspension from said handle in a substantially planar relationship when encircling said cups, said individually supporting means being sufficiently flexible to enable ones of said cup engaging portions to move to a non-planar relationship when not encircling a cup and supporting each of said cups in a substantially level condition when suspended from said handle so that as many as a predetermined number of cups are suspended in a substantially level condition.

17. A cup carrier as claimed in claim 16, wherein said cup carrier is cut from a sheet of flexible material.

18. A cup carrier as claimed in claim 16, wherein said individually supporting means includes support webs extending from said handle to substantially opposite sides of each of said cup engaging portions.

* * * * *